United States Patent [19]

Halterman

[11] 4,020,985

[45] May 3, 1977

[54] EQUIPMENT HOLDER

[76] Inventor: Kenneth Lowder Halterman, 2232 Vimont Ave., Salt Lake City, Utah 84109

[22] Filed: Aug. 9, 1974

[21] Appl. No.: 496,062

[52] U.S. Cl. ..... 224/5 R; 24/265 R; 24/3 R; 2/315

[51] Int. Cl.[2] ..... A45F 3/00

[58] Field of Search ..... 224/5 A, 5 R, 5 B, 5 H, 224/5 J, 26 R, 26 B, 26 K, 28 R, 28 A, 45 R, 45 T, 45 Q, 55, 56; 24/65 BT, 65.1 R, 265 R, 265 AL, 265 EC, 265 BC, 3 M, 3 R; 2/300, 312, 315, 319

[56] References Cited

UNITED STATES PATENTS

| | | | |
|---|---|---|---|
| 1,971,571 | 8/1934 | McMullen | 224/5 A |
| 2,388,811 | 11/1945 | Zatko | 224/5 A |
| 3,369,723 | 2/1968 | Saari et al. | 224/5 R |
| 3,612,260 | 10/1971 | Brilhart | 224/45 T |

FOREIGN PATENTS OR APPLICATIONS

| | | | |
|---|---|---|---|
| 52,062 | 6/1933 | Norway | 224/58 |

*Primary Examiner*—Robert J. Spar
*Assistant Examiner*—Kenneth Noland
*Attorney, Agent, or Firm*—B. Deon Criddle

[57] ABSTRACT

An equipment holder for policemen, security officers and the like that will mount on a belt and that will alternatively carry a policeman's baton or a large heavy duty flashlight in such a manner that they are readily accessible and without warning noise. The holder comprises a strap with a belt loop formed in one end thereof and a small ring at the other end. A larger ring is concentrically mounted around the small ring and a substantially rigid spacer is positioned between the rings and their pivot connections with the straps.

2 Claims, 5 Drawing Figures

EQUIPMENT HOLDER

BRIEF DESCRIPTION OF THE INVENTION

1. Field of the Invention

This invention relates to devices for holding a police billy club, nightstick or riot stick and for alternatively holding a heavy duty flashlight on a user's belt.

2. Prior Art

The need for a holding device that will allow elongate, usually cylindrical items such as policeman's batons, nightsticks, etc., to be easily and conveniently carried and readily removable for use, as needed, has long been recognized. To meet this need there has been developed and is commercially available a ring holder comprising a ring pivotally mounted on a strap having a belt loop therethrough. In use, the ring is suspended by the strap from a user's belt and is pivoted to a position where the elongate item can be inserted therethrough. The ring has an inside diameter slightly larger than the outside diameter of a length of the elongate item to be held and the item is held in place by a binding action occurring as a result of the tendency of the ring to swing downward under the force of gravity and/or by engagement of an enlarged portion of the elongate object with the ring.

SUMMARY OF THE INVENTION

Principal objects of the present invention are to provide an equipement holder that will provide better holding power than the ring holder heretofore known and that will hold elongate items of equipment having considerably different diameters.

Still other objects are to provide such a ring holder that can be economically produced and that is durable, and to provide a ring holder that will not generate noise during the use thereof.

Principal features of the invention include a strap, which is preferably made of leather, and a pair of spaced apart concentric rings made of stainless steel or the like. Leather is a preferred strap material because of its appearance and because it provides the desired degree of flexibility and rigidity, but it will be apparent that other materials having the same or similar characteristics can also be used. Similarly, stainless steel is preferred as the material for the rings, because of its appearance, strength, durability and weight, but other materials such as chrome plated steel or other suitably strong and durable coated or uncoated materials can be used.

The concentric rings are each pivotally mounted to the strap at one point on their circumference and a substantially rigid spacer is positioned between them. The strap is constructed to minimize movement of the rings, other than in the direction afforded by the pivotal mounting and because of this construction and their concentric relationship the rings do not engage one another and do not jingle or clank during use.

Further objects and features of the invention will become apparent from the following detailed description and drawing, disclosing what is presently contemplated as being the best mode of the invention.

THE DRAWING

In the drawing:

FIG. 1 is a front elevation view of an equipment holder of the invention;

FIG. 2, a side elevation view;

FIG. 3, a vertical section, taken on the line 3—3 of FIG. 1;

FIG. 4, a perspective view of the holder, shown supporting a policeman's baton; and FIG. 5, a view like that of FIG. 4, but showing the holder supporting a heavy duty flashlight.

DETAILED DESCRIPTION

Figure 1:
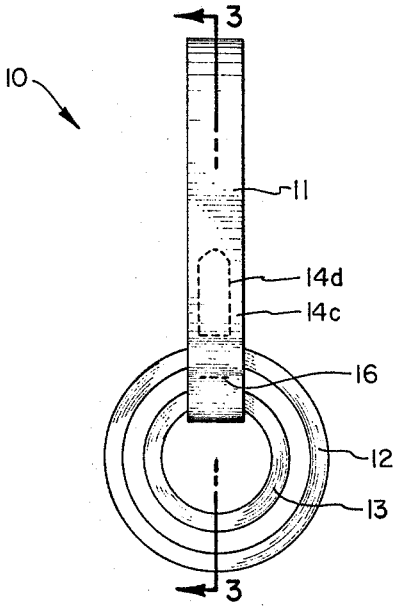
Figure 2:
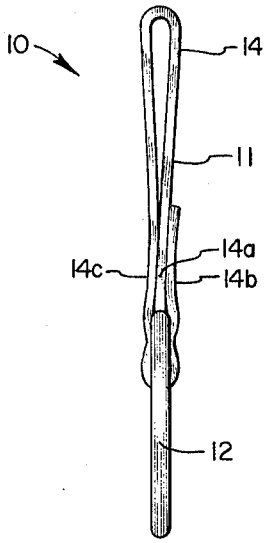
Figure 3:
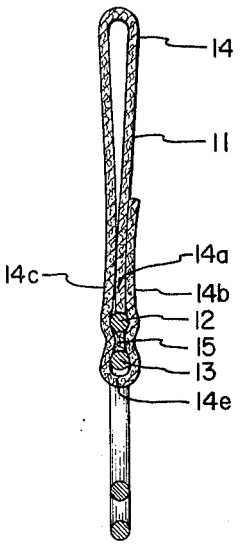

Referring now to the drawing:

In the illustrated preferred embodiment, the equipment holder of the invention, shown generally at 10, includes a strap portion 11, an outer ring 12, and an inner ring 13.

Strap portion 11 comprises a loop 14 formed by doubling one end **14*a* back over the other end 14*b* and securing the end 14*a* to the end 14*b* and to a portion 14*c* of the strap by a seam 14*d***.

The outer ring 12 is positioned against the end **14*b* and between a portion of the doubled back end 14*a* and the strap portion 14*c***.

A substantially rigid spacer 15 is positioned between the doubled back end **14*a* and the strap portion 14*c* at the side of the portion of the outer ring 12 opposite to the end 14*b*, and is secured to the end 14*a* and strap portion 14*c* by a seam 16**.

Inner ring 13 is concentrically mounted within outer ring 12 and has a portion positioned between the substantially rigid spacer 15 and the curved portion **14*e* of the strap formed between strap portion 14*c* and the doubled back end 14*a*. The curved portion 14*e* and the rigid spacer 15 thus prevents movement of the inner ring in any direction where it might contact the outer ring 12. Similarly, the close fit between the strap end 14*b* and the substantially rigid spacer 15** prevents movement of the outer ring in any direction other than a swinging movement transverse to the plane of the ring and will not allow the outer ring to swing into engagement with the inner ring.

As illustrated, the substantially rigid spacer 15 is made of a piece of heavy leather that is sewn to the loop 14, but it will be apparent that other materials glued, riveted or otherwise affixed in place could be used. It is necessary, however, that the substantially rigid spacer fit closely against each of the rings and that it be rigid enough to prevent undesired free movement of the rings together.

Figure 4:
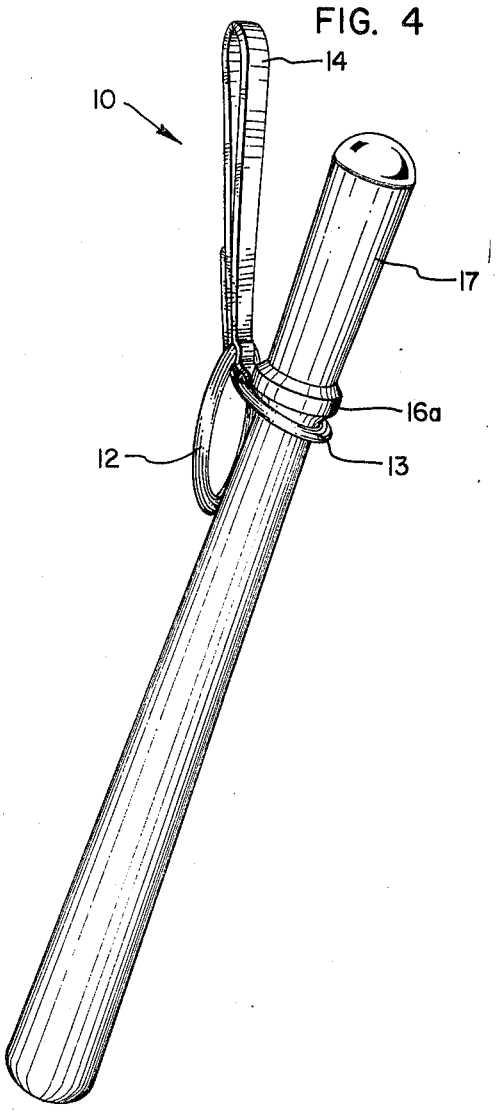

In practice, the loop 14 is positioned over a user's belt (not shown) and the strap then suspends the concentric rings 12 and 13 beneath the loop 14. When the user desires to carry a policeman's baton, nightstick, or other such item of equipment by the holder 10, the inner ring 13 is pivoted outwardly from his body and the equipment is dropped therein. If the equipment has an enlarged end, such as is shown in **16*a* on the baton 17 of FIG. 4, the enlarged end will hold the equipment from falling through the ring 13. In any event, the ring 13 tends to drop and to hold the equipment item against the ring 12**, and this clamping action between the rings very often is sufficient to hold the equipment item in place.

Figure 5:
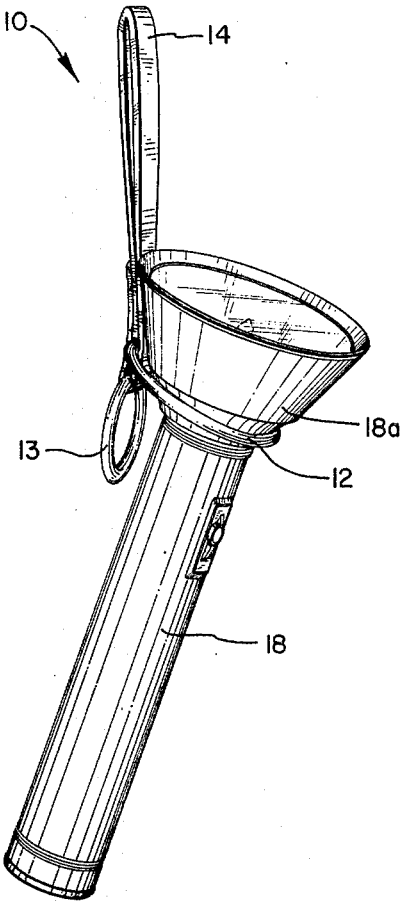

If a larger, elongated equipment item, such as the heavy duty flashlight shown at 18 in FIG. 5 is to be carried, the outer ring 12 is pivoted away from the user's body to allow for insertion of the equipment item therethrough. As when ring 13 is used, the ring 12 tends to drop against the equipment item and to clamp it against the downwardly hanging ring 13 and to hold it in place. In addition, an enlarged portion of the equipment item, such as the head 18*a* of the flashlight 18 will engage the ring 12 to prevent movement of the equipment item through the ring.

With the combination of the present invention, it is possible to alternatively carry elongate equipment items in a convenient fashion and to carry them without any noise caused by rattling or clanking of the component parts of the holder.

Although a preferred embodiment of my invention has been herein disclosed, it is to be understood that the present disclosure is by way of example and that variations are possible without departing from the subject matter coming within the scope of the following claims, which subject matter I regard as my invention.

I claim:

1. An equipment holder comprising a strap having a first end turned back to form a loop in one end thereof for supporting the holder in suspended relation from a belt carried about the body of a person:

a pair of concentric, rigid rings carried by the other end of said strap, said rings each having a portion engaging said strap; and a substantially, non-metallic spacer carried by said strap and separating the rings, whereby the outer of said concentric rings is between and restrained by the terminal edge of the first end and the said spacer, the inner ring of the concentric rings is secured between the substantially rigid spacer and a loop formed in the strap by the second end of the strap.

2. An equipment holder as in claim 1, wherein the strap and the substantially rigid spacer are of leather and the rings are of metal.

* * * * *